US011530889B1

(12) United States Patent
Sugg

(10) Patent No.: US 11,530,889 B1
(45) Date of Patent: Dec. 20, 2022

(54) FIREARM, TRIGGER ASSEMBLY, AND TRIGGER ASSEMBLY HAMMER

(71) Applicant: FCIP LLC, Chantilly, VA (US)

(72) Inventor: Edward Sugg, Chantilly, VA (US)

(73) Assignee: FCIP LLC, Chantilly, VA (US)

( * ) Notice: Subject to any disclaimer, the term of this patent is extended or adjusted under 35 U.S.C. 154(b) by 101 days.

(21) Appl. No.: 17/028,968

(22) Filed: Sep. 22, 2020

Related U.S. Application Data

(60) Provisional application No. 62/948,302, filed on Dec. 15, 2019, provisional application No. 62/936,397, filed on Nov. 16, 2019, provisional application No. 62/914,390, filed on Oct. 11, 2019, provisional application No. 62/903,934, filed on Sep. 22, 2019.

(51) Int. Cl.

| | |
|---|---|
| ***F41A 19/10*** | (2006.01) |
| ***F41A 19/42*** | (2006.01) |
| ***F41A 19/14*** | (2006.01) |
| ***F41A 19/09*** | (2006.01) |

(52) U.S. Cl.
CPC ..... *F41A 19/10* (2013.01); *F41A 19/09* (2013.01); *F41A 19/14* (2013.01); *F41A 19/42* (2013.01)

(58) Field of Classification Search
CPC ..... F41A 19/14; F41A 19/09; F41A 19/10; F41A 19/42; F41A 19/43
See application file for complete search history.

(56) References Cited

U.S. PATENT DOCUMENTS

| | | | | |
|---|---|---|---|---|
| 8,220,192 | B2 * | 7/2012 | Fluhr | F41A 19/14 89/146 |
| 8,893,607 | B2 * | 11/2014 | Audibert | F41A 19/14 42/69.01 |
| 9,683,800 | B2 * | 6/2017 | Sewell, Jr. | F41A 19/45 |
| 9,829,263 | B2 * | 11/2017 | Bonner | F41A 19/14 |
| 9,835,398 | B2 * | 12/2017 | Biegel | F41A 19/10 |

FOREIGN PATENT DOCUMENTS

WO WO-2020050749 A1 * 3/2020

* cited by examiner

*Primary Examiner* — Joshua T Semick
(74) *Attorney, Agent, or Firm* — ArentFox Schiff LLP

(57) ABSTRACT

A hammer usable with a firearm having a bolt carrier that is configured to travel forward and rearward within the firearm during a firing operation of the firearm. The hammer includes a mounting portion configured to rotatably constrain the hammer within the firearm and a firing pin contact portion configured to rotate upward to a vertical most position and contact a firing pin. The hammer further includes a sear notch configured to contact a trigger, and an extended surface that is configured to contact a bottom portion of the bolt carrier when the bolt carrier travels in a rearward direction after firing of the firearm. The extended surface allows for additional travel of a bolt carrier group of the firearm.

19 Claims, 4 Drawing Sheets

FIREARM, TRIGGER ASSEMBLY, AND TRIGGER ASSEMBLY HAMMER

The present Application for a Patent claims priority to U.S. Provisional Application No. 62/903,934, titled "Bolt and Bolt Catch Overtravel," filed on Sep. 22, 2019, and U.S. Provisional Application No. 62/914,390, titled "Firearms and Small Arms," filed on Oct. 11, 2019, and U.S. Provisional Application No. 62/936,397, titled "Further Improvements to the Stoner System—Buffer, Cam Path, Action Spring," filed on Oct. 16, 2019, and U.S. Provisional Application No. 62/948,302, titled "Further Improvements to Stoner Pattern Arms," filed on Dec. 15, 2019, the disclosures of which are incorporated herein by reference in the entirety.

BACKGROUND

The basic mechanical structure of AR-15, M-16, HK 416, HK 417, HK MR556, FN SCAR, and SIG 516, among other similar firearms, is known in the art. FIG. 1 shows an exploded view of a standard AR-15, which serves as an example of a firearm to which the inventive improvements disclosed herein may be applied. As shown in FIG. 1, the AR-15 firearm 10 includes, among other elements, a buttstock 12, a lower receiver 14 with an upper or top edge 75, a handle 16, a magazine well 18, a magazine 20, a trigger 22, a barrel 24, a bolt carrier 26, a bolt 28, a firing pin 30, a charging handle 32, an upper receiver 34, a gas tube 36, a bolt catch 38, a sight 40, gas rings 42, a magazine catch 44, and a magazine release button 46. Standard operation of the AR-15 firearm is well known in the art.

There remains a need in the art for firearms of the direct impingement and piston type that allow for faster reload, more controllable firing rate, a reduced failure rate, and easier operation, as compared to current semi-automatic or automatic type firearms.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In one aspect of the disclosure, a firearm is disclosed. The firearm includes a lower receiver with a top edge and a bolt carrier assembly. The bolt carrier assembly includes a bolt carrier configured to slideably engage with a bolt along a first axis, wherein the bolt is configured to engage and disengage from lugs of a barrel extension of the firearm and a firing pin configured to slideably engage with the bolt carrier assembly along the first axis. The firearm further includes a trigger assembly including a trigger pivotally connected to the firearm and a disconnector configured to engage with the trigger. A hammer is configured to engage with the trigger and having a firing pin contact portion configured to rotate upward to a vertical most position and contact a firing pin, wherein the hammer further comprises an extended surface that is configured to contact a portion of the bolt carrier when the bolt carrier travels in a rearward direction after firing of the firearm.

In one aspect, the extended surface mentioned above extends from about 0.952 inches to about 1.80 inches above the top edge of the lower receiver when the hammer is rotated upward to the vertical most position. The extended surface may extend less than 1.50 inches above the top edge of the lower receiver when the hammer is rotated upward to the vertical most position.

In one aspect, the aforementioned hammer may have a width between about 0.300 inches and about 0.315 inches. In one aspect the hammer may have a width between about 0.150 inches and 0.299 inches, and wherein the extended surface extends greater than about 0.800 inches above the top edge of the lower receiver when the hammer is rotated upward to the vertical most position. In one aspect, the extended surface may extend less than 1.5 inches above the top edge of the lower receiver when the hammer is rotated upward to the vertical most position.

In one aspect of the disclosure a hammer usable with a firearm is disclosed. The firearm may a bolt carrier that is configured to travel forward and rearward within the firearm during a firing operation of the firearm. The hammer includes a mounting portion configured to rotatably constrain the hammer within the firearm and a firing pin contact portion configured to rotate upward to a vertical most position and contact a firing pin. The hammer further includes a sear notch configured to contact a trigger, and an extended surface that is configured to contact a bottom portion of the bolt carrier when the bolt carrier travels in a rearward direction after firing of the firearm. The extended surface allows for additional travel of a bolt carrier group of the firearm.

In one aspect, a trigger assembly usable with a firearm is disclosed. The firearm may include a bolt carrier that is configured to travel forward and rearward within the firearm during a firing operation of the firearm. The trigger assembly may include a trigger pivotally connected to the firearm and a disconnector configured to engage with the trigger. The assembly may include a hammer configured to engage with the trigger and having a firing pin contact portion configured to rotate upward to a vertical most position and contact a firing pin, wherein the hammer further comprises an extended surface that is configured to contact a portion of the bolt carrier when the bolt carrier travels in a rearward direction after firing of the firearm.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The novel features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation or context. The example definitions are not intended to be limiting.

Throughout the disclosure, the term "substantially," "approximately" or "about" may be used as a modifier for a geometric relationship between elements or as a modifier for a numeric value. While the terms substantially, approximately, and about are not limited to a specific variation and may cover any variation that is understood by one of ordinary skill in the art to be an acceptable variation, some examples are provided as follows. In one example, the terms substantially, approximately, or about may include a variation of less than 10% of the dimension of the object or component or numerical value. In another example, the terms substantially or approximately may include a variation of less than 5% of the object or component or numerical value. In another example, the terms substantially or approximately may include a variation of less than 3% of the object or component or numerical value or less than 2% of the object or component or numerical value. If the terms substantially, approximately, or about are used to define the angular relationship of one element to another element, one non-limiting example of the terms may include a variation of 5 degrees or less. These examples are not intended to be limiting and may be increased or decreased based on the understanding of acceptable limits to one of ordinary skill in the art.

Further example definitions are described with respect to aspects described below.

Bearing Surface—Hammer—Bearing Surface and Height Innovations

Figure 1:
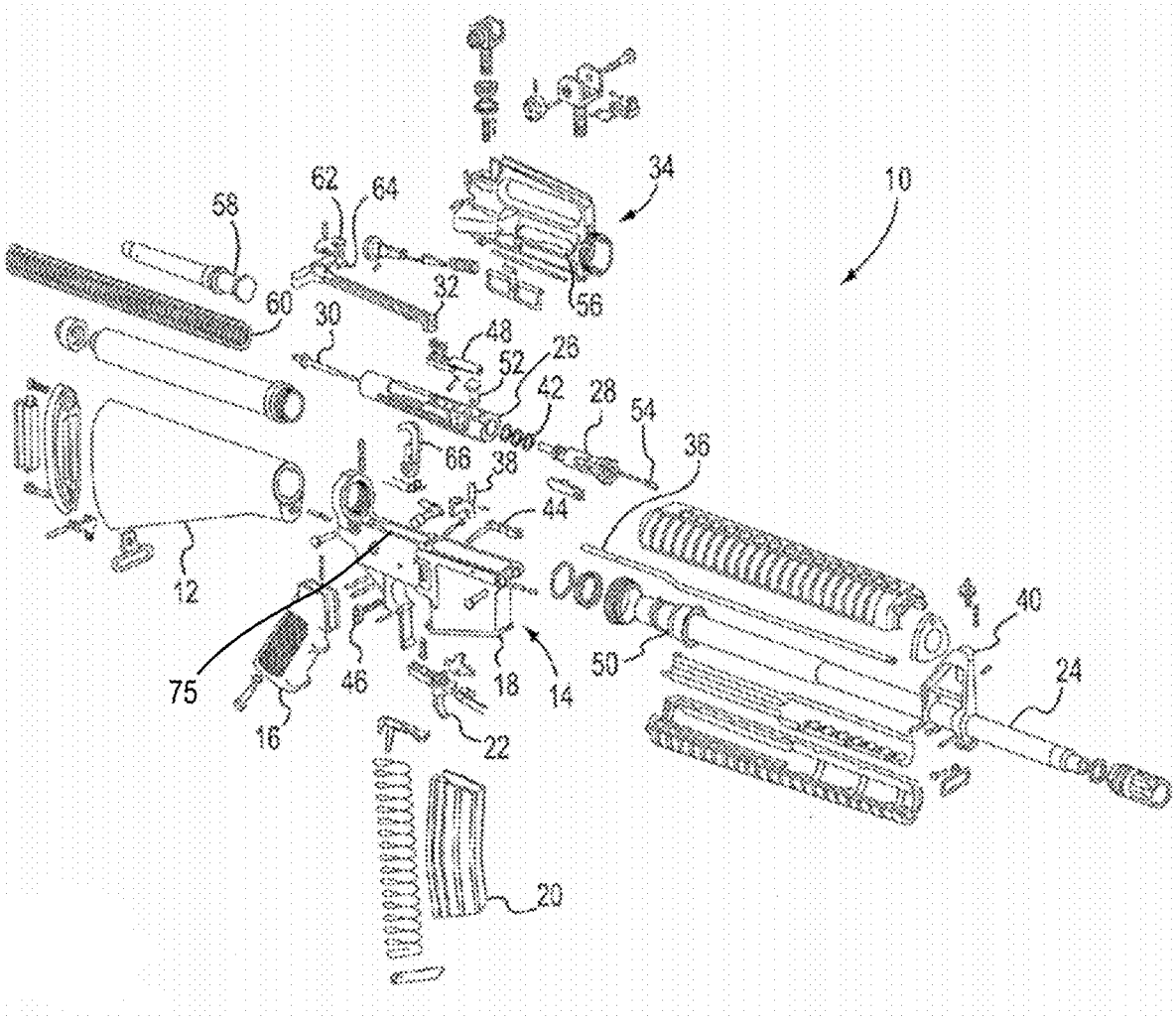
FIG. 1 Related Art
FIG. 1 shows an exploded view of an example AR-15 firearm usable in accordance with aspects of the present disclosure.
Figure 2A:
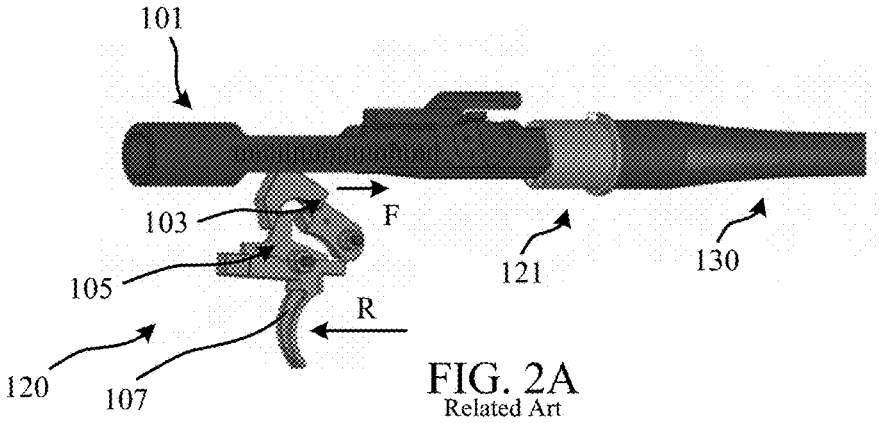
FIG. 2A Related Art
FIGS. 2A-2D are partial views of a firearm showing an example operation of a trigger mechanism and bolt carrier group.
Figure 2B:
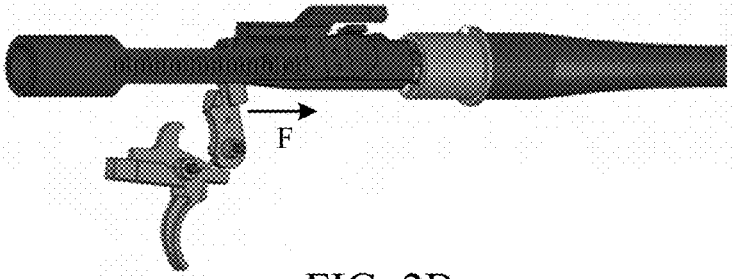
FIG. 2B Related Art
Figure 2C:
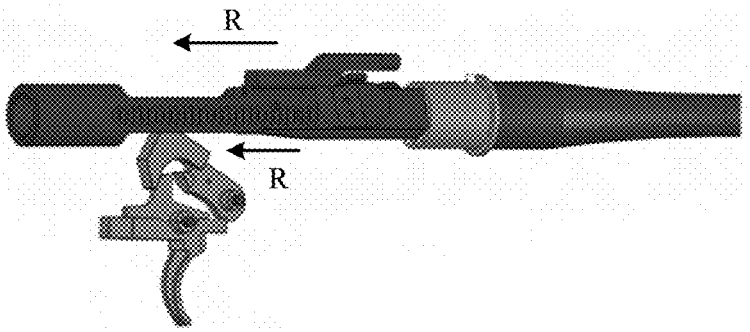
FIG. 2C Related Art
Figure 2D:
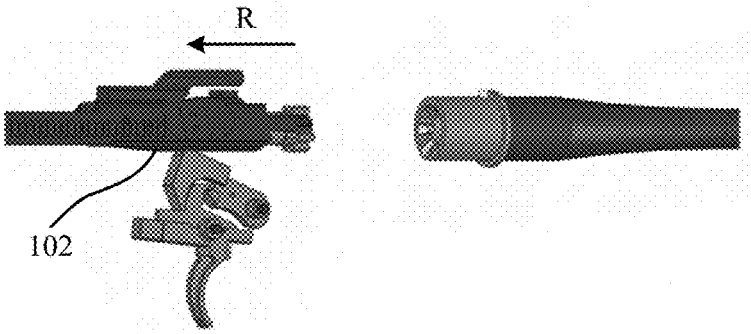
FIG. 2D Related Art

In one aspect of the disclosure, moving the contact surface of the Hammer rearward from the furthest point currently available (TDP "Radius" Hammer) and also raising the height of the Hammer as positioned in the Lower Receiver is disclosed. FIGS. 2A-2D show examples of an interaction between a bolt carrier group 101 and the trigger assembly 120. As shown in FIG. 2A, when the trigger 107 is pressed rearward in direction R, the hammer 103 travels forward in direction F as shown in FIG. 2B to a forward and vertical most position. The hammer 103 strikes the firing pin (e.g., firing pin 54 in FIG. 1) which causes a cartridge to fire. Once the cartridge is fired, the bolt carrier group 101 travels rearward in direction R. the hammer 103 also travels rearward in the direction R. As shown in FIG. 2D, once the bolt carrier group travels rearward in direction R, a bottom surface 102 of the bolt carrier contacts a bearing surface (e.g., surface 220 in FIG. 3) of the hammer.

The movement rearward of the contact or bearing surface 220 is measured at the cocked or cocking position as the bolt carrier causes the hammer to move rearwardly into the cocked position. This position is where the hammer is set for the next shot in semi-automatic fire, or is moved rearwardly ready to be tripped by the auto sear (e.g., sear 221 in FIGS. 3 and 4) in full automatic fire.

Figure 3:
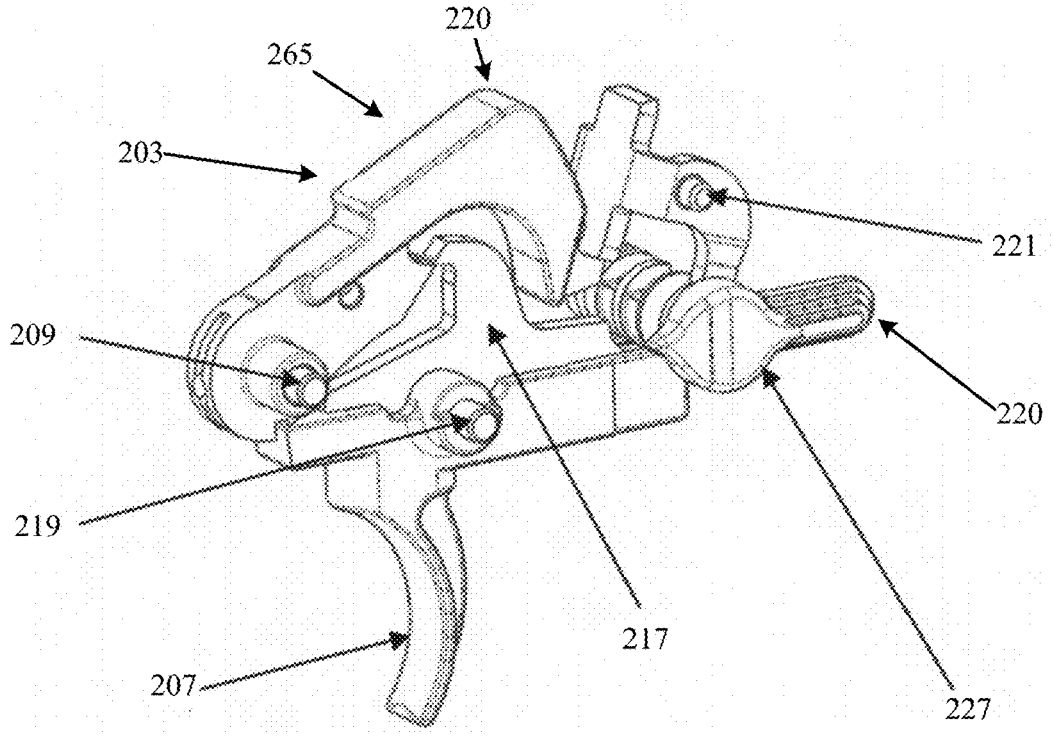
FIG. 3 Related Art
FIG. 3 shows an example of a related art trigger assembly.

FIG. 3 shows a related art trigger assembly. The trigger assembly 220 may include a hammer 203 that is pivotally mounted to the firearm, for example to the lower receiver via pivot 209. The trigger assembly may further include a trigger 207 that is pivotally mounted to the firearm, for example to the lower receiver via a pivot 219. The trigger assembly may further include a disconnector and a safety and/or selector switch 227.

By raising the height of the Hammer relative to the upper edge of the Lower Receiver, the Bearing surface of the Hammer—that which contacts the underside of the Bolt Carrier—may be moved rearwardly which enables longer "stroke" or "travel" to the Bolt Carrier than is currently possible. This creates the greatest possible gap between the Bolt Lugs and Bolt Catch.

Figure 4:
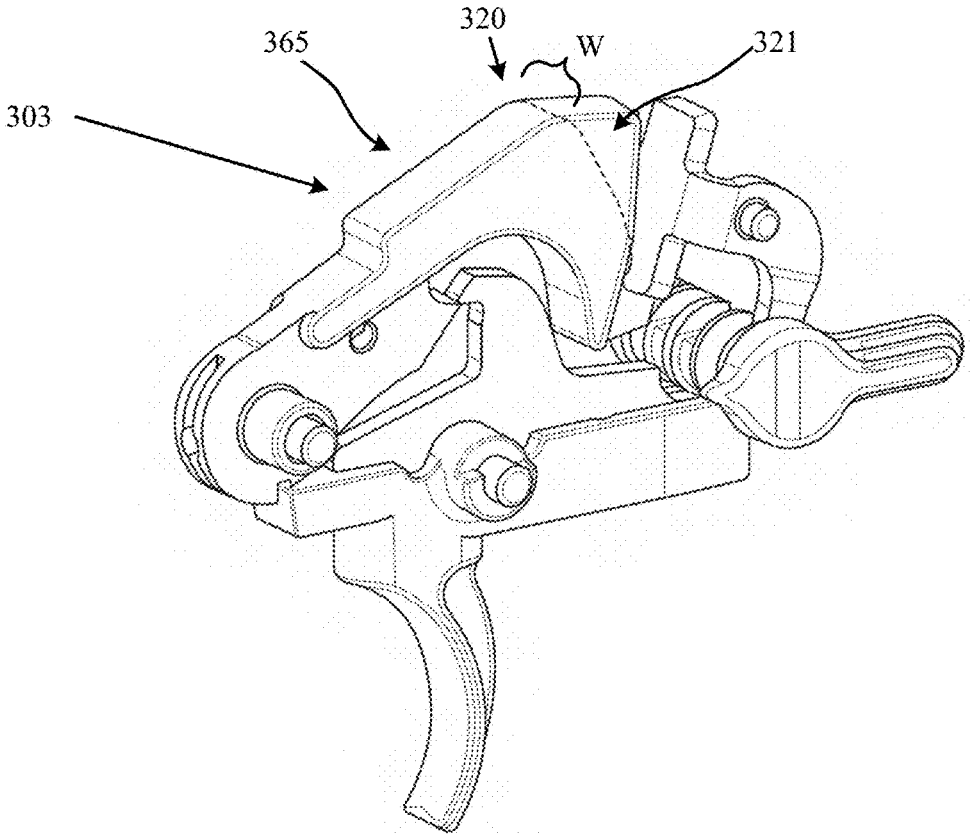
FIG. 4 shows an example of a trigger assembly and hammer in accordance with one aspect of the disclosure.

FIG. 4 shows one example of a trigger assembly in accordance with the current disclosure. Feature that are alike or similar to features in FIG. 3 are not provided with reference numbers to prevent obstruction of features. As shown in FIG. 4, the hammer 303 may for example include a firing pin contact portion 365 configured to rotate upward and contact a firing pin. The hammer 303 may further include an extended surface 321 that is configured to contact a portion of the bolt carrier when the bolt carrier travels rearward after firing the firearm. The extended surface 321, which may be interchangeably referred to as a bearing surface, may extend further rearward and/or upward that the bearing surface in FIG. 3, for example. The dotted line in FIG. 4 shows a comparison between the bearing surface in FIG. 3 and one example of aspects of the current disclosure. The bearing surface or extended surface 321 may allow for extended rearward travel of the bolt carrier group without causing the front face of the bolt carrier to jamb due to undesired contact between the bolt carrier and the hammer or upward contact of the hammer, and subsequent contact between the bolt carrier when the bolt carrier is in the rearward most position (e.g., rearward of the position shown in FIG. 2D). As shown in FIG. 4, the hammer may have a hammer width W. In one example aspect, the hammer may have a width between about 0.300 inches to about 0.315 inches. In another aspect, the hammer may have a width W between about 0.150 inches and 0.299 inches. In another aspect, the hammer may have a width W between about 0.150 inches and about 0.250 inches.

The TDP "notched" pattern triggers have a bearing surface (the part of the hammer that remains in contact with the bolt carrier underside when the action is cycling) that is effectively flush with the firing pin contact area—using little or no radius. This is the "face" portion (e.g., face 265 in FIG. 3) of the hammer (e.g. hammer 220 in FIG. 3) that strikes the firing pin. This area is about 0.775" above the upper edge (e.g., edge of 75 shown in FIG. 1) of the lower receiver 14 (FIG. 1). The Notch pattern hammer permits the least amount of rearward Bolt Carrier movement before the Carrier "falls off" of the Hammer bearing surface. This may cause a stoppage or jamming that precludes further operation of the firearm The hammer may have a radius (radius as shown in FIG. 3) with a bearing surface that is about 0.080-0.100" to the rear of the face or firing pin contact area. This bearing may be about 0.915-0.920" or so above the upper edge of the lower receiver. This permits the greatest possible rearward movement of the bolt carrier in an AR (meaning AR10 or AR15 and variants et al) pattern firearm before the bolt carrier "falls off" of the hammer.

Figure 5:
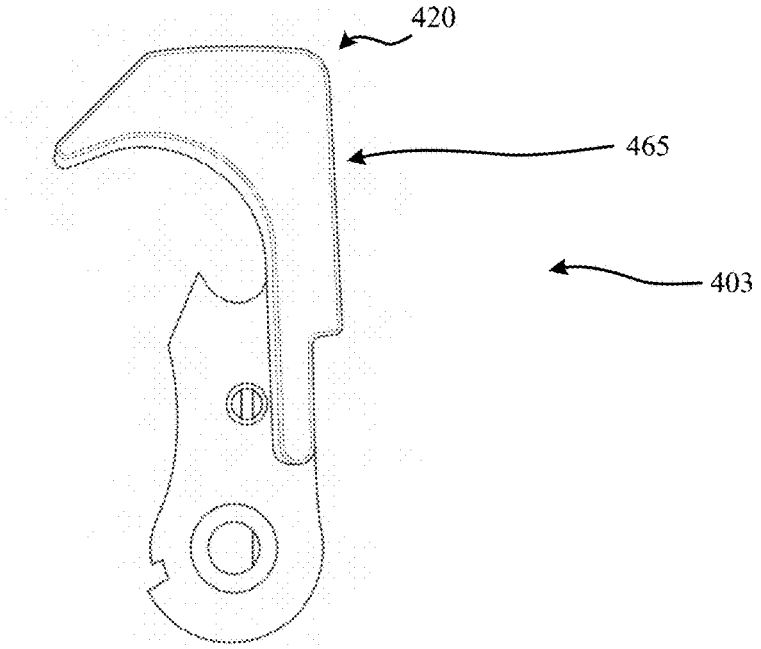
FIG. 5 Related Art
FIG. 5 shows an example of a related art hammer usable with a firearm.
Figure 6:
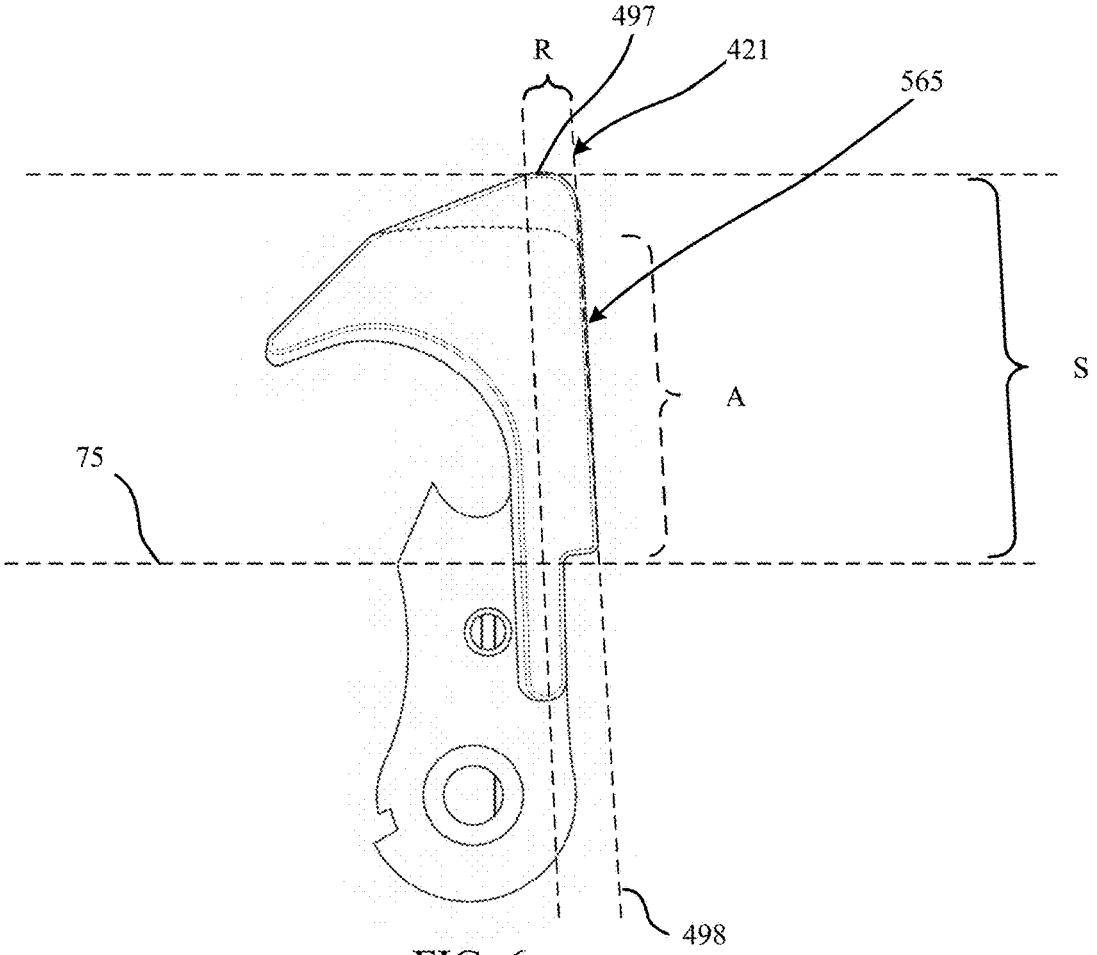
FIG. 6 shows an example of a hammer in accordance with one aspect of the disclosure.

FIG. 5 shows one example of related art hammer with a firing pin contact surface or face 465 that is configured to rotate upward to a vertical most position and contact a firing pin of a firearm. As shown in FIG. 5, a hammer in accordance with one aspect of the disclosure may have an extended surface 421 that extends beyond the surface 420 shown in FIG. 5. FIG. 6 includes a dotted line 75 denoting the position of the upper edge of the lower receiver (e.g., upper edge 75 of lower receiver 14 in FIG. 1). As shown in FIG. 6, the extended surface 421 may extend a distance S from the upper edge 75 of the lower receiver when the hammer is in the most vertical position during operation, the distance S may be greater than a distance A that a typical hammer extends above the upper edge 75. In one example, the extended surface 421 may extend a distance S from about 0.952 inches to about 1.80 inches above the top edge of the lower receiver when the hammer is rotated upward to the vertical most position. In another aspect, the extended surface 421 may extend a distance S between about 0.952 inches to about 1.50 inches above the top edge of the lower receiver. In another aspect, the extended surface 421 may extend a distance between about 0.960 to about 1.50 inches from a top edge 75 of the lower receiver. It is noted that the dimensions S in FIG. 6 may be identical for the aspects shown in FIG. 4. In one example, the hammer may have a width (e.g., width W shown in FIG. 4 between about 0.300 inches and about 0.315 inches.

As shown in FIG. 6, the front face or firing pin contact face 565 may include a flat surface. In one example, the aforementioned extended surface 421 may include a chamfered or rounded portion that is configured to contact the bolt carrier. The chamfered or rounded portion may for example extend rearwardly from the firing pin contact face 565 a distance R. In one example the distance R may be between 0.050 inches and 0.100 inches. In one example the chamfer may have a radius that is between 0.050 and 0.100 inches. In one example, the halfway point 497 between the end of the beginning of the radiused or chamfered portion that begins at the front face or firing pin contact face 565 may be located a distance of approximately 0.050 inches from front face or firing pin contact face 565. In another example, the radius may be greater than about 0.050 inches or 0.0100 inches.

Match style triggers may have a bearing surface that is between the notched version and the radius version. It is about 0.811" or so above the upper edge of the lower receiver and the bearing surface extends back about 0.060" or so from the face or firing pin contact area. The match trigger may have a hammer with a width between 0.150 inches and 0.299 inches and more preferably between 0.150 inches and 0.299 inches. In the case of a match trigger, the extended surface distance S may be greater than 0.800 inches. In one aspect the extended surface distance S may be between 0.800 inches and 1.5 inches.

The aforementioned extended hammers may to promote additional bolt carrier stroke, and may have a bearing surface that is more than 0.915-0.920" or so above the top edge of the lower receiver—and/or a bearing surface that is more than about 0.080" or so, and perhaps as much as more than 0.100-0.125" or so or more from the face or firing pin contact area. This change permits for the use of the longest possible travel of the bolt/bolt carrier, and the furthest movement of the bolt lugs past the bolt catch.

The hammer may have a bearing surface that is a maximum of about 1.50-1.80" or more above the upper edge of the lower receiver and a bearing surface that is as much as 0.100-0.125" or more up to about as much as 0.250-0.750" from the face of the hammer. With unusual or innovative hammer geometry, changes past 0.750" in distance past the face are also possible.

Additional Bolt/Bolt Catch Clearance—Stoner Pattern Firearms Including Variants

In review of numerous firearms and weapons, it has been noted by this author that firearms which follow the "Stoner Pattern" Lug usage and Rotation uniformly incorporate a couple of design flaws that are apparent when using a Bolt Catch.

The Stoner Pattern is the most popular system in the Western World for individual small arms and is used in most modern semi auto and select fire weapons and firearms.

By Stoner Pattern, we mean a Bolt Pattern which typically uses nominal 8 Bolt Lugs (1 of which is replaced by the Extractor—so 7 in most cases—though some have fewer lugs—such as, for example, the IMI Tavor) and about a 22.5 degree Bolt rotation between Locking and Unlocking—that is fully locked into battery, and fully unlocked out of battery. This is most notable where cartridge cases are at least 25 mm (about 1") or more. Typically, the longer the cartridge the more acute the problem is.

Firearms using the Stoner Pattern have the advantage of a well proven history and the functional advantage of using a "Bolt Catch". The Bolt Catch is a device typically actuated by the Magazine follower, which rises upon the last round being fired from the Magazine. The rise of the Bolt Catch enables it to trip or stop the Bolt and holt it open. Thus the Bolt is literally "caught" by the Bolt Catch. This is a useful safety and functional feature to have. It shows that the firearm is "clear" of any rounds that might be fired which increases safety—and it also lets a fresh Magazine (which has cartridges loaded into it) be loaded into the magazine well without having to manually pull the Bolt/Bolt Carrier to the rear via the cocking or charging handle. This makes operation faster and easier as the Bolt/Bolt Carrier can be sent forward by merely actuating the device (Bolt Catch) to release the Bolt forward and feed a new round from a fresh magazine.

The issue is that as originally designed in the Stoner Pattern systems (and derivatives following that pattern as described), the "gap" or distance between the front face of the Bolt Lugs (those directed towards muzzle while in use) to the rear face or edge of the Bolt Catch (that is directed away from the muzzle, and towards the rear of the firearm or weapon) is only about 0.125" or so. The Bolt Lugs must clear or pass the Bolt Catch in order for the device to function properly. Due to tolerances and variances, this nominal 0.125" distance my be as little as 0.080-0.100" and in some cases may extend slightly beyond about 0.130" or so. This leaves very little room between clearance of the Bolt Catch and impact of the rear of the Bolt Carrier to the weapon. The author has noted previously that reducing the carrier and gas key (feature found on Direct Impingement—DI—guns) length along with buffer or buffer tube changes can increase this distance meaningfully—ideally to over about 0.200" or more. This has also been noted in other parts (such as described below) and is explicitly restated here. In cases where there is no buffer or conventional gas key, other parts of the Bolt carrier may be shortened (as measured from Carrier "Face" to the rear) in order to promote greater than about 0.130" to about 0.200" or preferably greater cycling movement or travel or stroke of the Bolt Lug face past the rear edge of the Bolt Catch. This is most notable in actions using cartridge cases at least 25 mm (about 1") long—and more acute as the cartridges become longer due to the premium on space and the extant problem—such as the 5.56 mm×45 mm case or 7.62×51 mm case and similar variants as examples.

Depending on the configuration of the Bolt Carrier, as well as size of the caliber and system, different components may need to be redesigned in order to permit this additional clearance. This could include the Carrier itself, and it could include the operating rod (op rod) which is driven by the piston. In essence, it is the longest component towards the rear of the action relative to the length of the receiver. In systems such as those described below, it may be the rear of the Bolt Carrier body—especially those which operate without a "buffer". The Buffer is a weighted assembly that creates additional overall length on many "AR" (Armalite Rifle) pattern guns.

Many firearms and weapons do not use a Buffer, and in cases where an AR pattern gun does not the changes described are entirely relevant and applicable as well. This is in order to create the at least 0.200" and preferably more space between clearance of the Bolt Catch by the Bolt and the "bottoming out" or maximum rearward travel in normal cycling.

On a SIG MCX, as an example, and similar pattern (where carrier length is the main obstacle to increased bolt/bolt catch travel) guns, the Bolt Carrier may be shortened from the present length in order to gain additional travel and distance between the Bolt/Bolt Catch from initial clearance to final rearward movement. As an example, the SIG MCX limiting factor to additional rearward movement is the overall length of the Bolt Carrier and how this length impedes more than about the standard (nominal 0.125-0.130") Bolt/Bolt Catch clearance. The Sig MCX is used as an example here because it is "piston" operated (thus has no gas key) and also it does not use a Buffer—but it still suffers from inherent design limitations which impede more than normal Bolt/Bolt Catch clearance (0.125-0.130" or so) and preclude desirable increases to about 0.200" or so and preferably more space—as much as possible within the physical constraints of the system. All firearms using the Stoner Pattern (lug pattern and 22.5 degree or so unlocking) should be considered disclosed for these improvements.

Certain firearms do not use this pattern—for instance the widely used "AK" pattern firearms as well as those such as the German G3 rifle—all variants to the same are included by reference. Neither type uses a Bolt Catch. The G3 and variants are "roller locked" where rollers are used to control the unlocking of the Bolt. AK pattern guns use a different number of Lugs and rotation pattern.

In all cases where a rotating Bolt (generally following the Stoner pattern as described) is used along with a Bolt Catch, the maximum possible clearance between the Bolt Lugs and Bolt Catch as described above is desirable. While an increase to at least 0.200" or more of clearance is desired, as much space as possible is even more desirable. This provides about a 50% gain over current architecture, but further increases to the limit of any relevant system is possible. On AR pattern systems, this author has seen increases to over 0.525" and more with it believed that the total can be increased to about 0.526" to as much as about 1.250"—and even more if the receiver is lengthened or other major parts are re-engineered. This increase can apply to any weapon using this "Stoner" pattern whether Piston or DI operated, and whether a Buffer is used or not. This increase from standard 0.125" or so may go from, 200-0.400", or 0.400-0.600", or 0.600-0.800", or about 0.800-1.125" or more or so. As mentioned above, further increases may be possible if major components such as receivers are elongated or changed. Obviously, the more minor the changes, the greater the chance of more widespread adoption.

While some concern may exist about Bolt Catch life with additional forces from increased Bolt runup (movement), extensive live fire testing with ordnance grade steel Bolt Catches have shown no problems with part life. Obviously, the Bolt Catch should be made as strong and as durable as practically possible in any case.

Though described as "at least 0.200"" distance or space between the Bolt Lugs and Bolt Catch, it is preferred to create as much space as possible here as described above—and to increase any system to the greatest practical extent allowed.

This change in Bolt/Bolt Catch overtravel is desirable because it typically softens recoil and also promotes better feeding in every known case.

Buffer—See Sketch "FIG. 9B"

The use of different size (i.e. physical length) weights in the same buffer is disclosed as a method for providing the maximum possible sliding weight in the shortest possible Buffer. This is critical when buffers are less than about 2.75-2.85". That is typically the smallest size Buffer that can accommodate 3 standard size weights. Three weights is the standard number for "carbine" length buffers that are normally about 3.25" long. A short proprietary Buffer for the AR10 has two standard size weights and is about 2.50" long. The challenge is that some systems require a shorter buffer for use in a carbine length buffer tube (nominal 7.25" long). Thus using weights of different lengths enables more flexibility on both weight and buffer length. The AR10 buffer cited above has about 80 grams of sliding weight and the standard carbine buffer will have 60 grams, with the "H" version having 80, and the "HZ' having 100 grams. Thus a very short Buffer may still have about 80-100 grams of sliding weight with a length of about 2.30-2.65". An ultra short buffer may have about 80 grams with a length of about 1.80-2.30", and a reduced ultra short buffer may have about 60 grams of sliding weight at about 1.20-1.80" in length. Sliding weight is very important because of the way it serves to deaden recoil impulse, promote more reliable operation, etc.

One method of ensuring the broadest range of sizes are available to the shooter is to provide a removable "head" on the buffer—this is the forward portion opposite the buffer bumper on the rear end. The removable head may use threads or may be pinned or use any mechanical attachment method—ideally this will be coupled with Buffer "bodies" of different lengths which enable the shooter to tune the exact travel (to obtain optimal bolt/bolt catch overtravel, for example) and buffer weight suitable for their circumstances.

Gas Key—Thread on or Dovetail—Reduce Length—Nozzle Front to Rear Most Portion

The use of a Gas Key that mounts to the Bolt Carrier via threaded attachment (where the gas key literally has male or female threads that protrude or recede and match corresponding threads on the bolt carrier) is disclosed here with the goal being to shorten the rearmost portion of the gas key (which limits rearward movement of the system in normal condition) as measured from the front or nozzle to the rearmost section of the key. Alternately, and repeated here, any other mechanical attachment of the Gas Key to the Carrier is disclosed which may include but not limited to dovetail notches. The dovetail notch could be formed on the carrier or the key with the corresponding portion on the opposite part. A particular method would be either transverse (90 degrees to bore direction) mount which could slide in from the side of the carrier—or longitudinal (slides in from the rear due to Cam Path, etc.) that is parallel to the bore—either could then be pinned in or otherwise mechanically secured.

The benefit to the above methods is that they allow the distance of the gas key as measured from front of gas hole (nozzle—at front end that mates to gas tube) to the rear most portion of the key to be as short as possible. With a shortened Gas Key that uses cap screw attachment methods previously disclosed by this author, the shortest that distance can reduced is about 1.75-2.07" total length while the methods described above enable a shorter distance. This permits the distance in question to be reduced to under 1.75" down to as little as about 1.40-1.55" or so. This is critical for maximizing carrier travel or stroke during cycling. Corresponding changes to the buffer length are a critical part of this. It becomes necessary to get the overall length of the Buffer to less than about 2.50-2.65" or so. Some other components such as charging handle (the slot and tabs as previously disclosed) and hammer are needed to support the longest possible carrier travel or stroke during firing operation. These changes permit additional travel on the AR15 and AR10 (and similar or equivalent systems) of increases of about 0.600" to about 1.250" or so of additional stroke or travel. This is in addition to other methods previously described by this author which permit additional movement of about 0.075-0.450", or 0.425-0.600" or so. This is compared to current stroke of the AR15 system of about 3.75" and the AR10 system of about 4.50" or so.

On the AR system, more than 1.10-1.25" of additional travel may be available but it requires very extensive system modification which limits the market plausibility of the system.

Another attribute of the improved Gas Key repeated here is the movement forward of the leading edge of the base—which mates to the corresponding area of the carrier. This is forward of the Gas Hole (on both the carrier and key) but rearward of the Gas Key nozzle (which mates up with the Gas Tube). Reducing the distance between the forward edge of the Noxxle and the forward edge of the base of the gas key which mates to the carrier is disclosed. This distance is now about 1.125-1.200", so reducing this to less than 1.125" ideally down to about 0.500-0.900" permits this portion of the Gas key base to be used as a mounting mechanism to the Bolt Carrier to provide the strongest, most secure connection.

Vents—See "Gas Vent Drawing"

The attached "Gas Vent Drawing" illustrates how additional vent holes may be added to the extant TDP (Technical Data Package) Carrier Vent Holes in order to dissipate pressure on the "internal in line piston" method of operation commonly referred to as "DI" or Direct Impingement. This would be more accurately referred to as "EG" or Expanding Gas method of operation in the opinion of this author. This system creates an internal "piston" where the Bolt and gas rings form the "piston" of the system and the Bolt Carrier Bolt Cavity or Bore or Bolt Recess forms the corresponding "cylinder" to the "piston" formed by the Bolt/Gas Rings. The "stroke distance" (movement from starting position shown to ending position where gas rings have passed the rear edge of the current existing Vent Holes as shown by 2 lines with arrow denoting stroke length) of the current system per TDP is about 0.200-0.225" or so depending on manufacturing tolerances, which part of the gas ring is used for reference, etc.

The "stroke distance" of the current system may be shortened by adding one or more new Vent Holes between the starting position of the Gas Rings and the rear edge of the current Vent Holes. The proposed illustrative New Vent holes are shown in dashed lines—which serve to shorten the effective piston distance thus lessening the amount of power driving the inline system. The system may less preferably also be adjusted by moving the Current Vent Holes rearwardly.

From the current size of about 0.200-0.225", the effective stroke length may be reduced by 1-10%, or 10-20%, or even 20-30%, or preferably 30-40%, or more preferably 40-50%, or even 50-60%, or even more preferably 60-70%, or even 70-80%, or as much as 80-90%. With careful adjustment and calculation, this may even be possible to go over 90-99%. The Vent may even be located "on" the location of the rear most gas ring-so neither behind or in front of as desired.

Note again that the stroke length in TDP conditions varies according to tolerances and the exact position of the gas rings when analyzing the system. The figures given are for a 5.56 mm TDP system—these will vary for any AR10 et al system and corresponding adjustments to the actual size should be considered—though percentage adjustments will correspond to those provided above.

The additional one or more Vent Hole(s) aft of the Gas Rings may be used to depressurize the system without impacting Stroke Length. That is, the location of these holes does not serve to limit or impact the Stroke Length.

The vent holes may be used behind the Gas Rings without impact on the Stroke Length, or they may be used in front of the Gas Rings but behind the extant TDP Vent Holes to limit the Stroke Length. The added position Gas Vents (that is, beyond existing TDP Vents) may be used separately or used in conjunction. The added Vents may consist of at least one "Aft" vent. The added Vents may consist of at least one "Interim" vent. They may be used separately or they may be used together. They may also be used with the TDP vent holes as they are, or the TDP vent holes may be enlarged or repositioned as desired to otherwise reduce the Internal Piston Stroke Length.

The Internal Piston Stroke Length may also be reduced by moving the current (existing) TDP Vents rearward from the current position, which places the aft tangent of the Vent Holes (noted by the solid line and solid holes) at about 1.395" from the reference Carrier Face or front face/edge of the Bolt Carrier. The Gas Vent Drawing shows the Bolt and Gas Rings within the Bolt Recess or Bore of the Bolt Carrier.

End Plate—Angled QD Mount Positions—See Sketch "End Plate w/Angled QD Mounts"

The use of an "End Plate" with sling mounting positions (or Quick Detachable—QD—slots) that fall between in line with the bore (facing toward buttstock end) and perpendicular to the bore (to left or right side) is disclosed. When the shooter has a weapon or firearm "slung" (that is hanging by a sling worn on the body), both positions are sub optimal as the sling or swivel attempt to fall between these positions based on how the firearm is placed on the body. This tends to bind up the swivels or the sling and sometimes catches the weapon or alters the natural sling position on the body. By positioning the QD swivels in between these two standard positions described above-preferable at about a 45 degree angle or about in between the two, the comfort of the slung weapon will be improved and the sling/swivel will operate in the manner it was intended to—and not bind to the weapon or alter the sling position on the shooters body. Thus the firearm or weapon will "hang" in a slung position more comfortable without sling/swivel "bind" or undesired sling movement. The 45 degree or so intermediate angle (btw 0-90 degrees) has been found to be the most natural and efficient angle in repeated assessment across a variety of clothing and gear—where the other currently available end plates bind or get hung up very easily.

Trigger Cover—for Trigger Between Pistol Grip and Mag Well

Targeted primarily for safety and legal compliance with AR "Pistols". Though this can be used for any firearm/weapon system that has a Trigger located between the Pistol Grip and Magazine Well. On a normal pistols- and many sub machine guns, the pistol grip is the magazine well. This is an invention similar to Trigger Guard Covers which are available for Pistols. These are typically made of injection molded plastic or a material known as "kydex". The existing art may typically be removed by pulling the Cover towards the muzzle of the pistol to remove it. That is not possible with the AR platform due to the size of the Magazine Well which blocks any forward movement—thus the creation of a Trigger Cover designed for the AR platform where the primary attachment point is a Trigger Guard which transits between the pistol grip (to the rear) and a Magazine Well (to the front). The Trigger Cover (which may be made of any suitable material) will have the Mag Well—not the trigger guard as is the case for a normal pistol—at the front. Removal will require a downward movement or "stroke" of the Cover to remove it and make the Trigger accessible to the shooter.

This is advantageous for safety reasons in all AR and similar pattern firearms and weapons regardless of size. When the firearm/weapon is "slung"—that is carried by the sling which enables the user to attach the firearm to their body—the trigger is exposed, as is the safety lever.

The AR Trigger Cover may cover the Trigger and Trigger Guard area which will prevent the trigger from being accidentally struck with a possible negligent/accidental discharge. This is a possibility now with hunters, soldiers, police officers, competitors and shooters who may carry their firearm or weapon "slung" particularly if they have various gear or clothing on which may hit the trigger. The same protruding gear or clothing that may hit the trigger may also move the selector from "safe" to "fire" which enables the trigger to operate.

Optionally, the Trigger Cover may also cover the safety selector in addition to the Trigger/Trigger Guard. Further, it may optionally cover the Magazine Release. This would dramatically increase the integrity of the firearm when handled frequently or roughly.

With the advent of AR "pistols" (short barrel versions which are legally classified in the US as pistols), there is the necessity to have the trigger covered to be considered "holstered" which is a requirement in many states and jurisdictions. Thus carrying an AR Pistol "slung" may not be considered "holstered", and the same applies as far as transporting said firearm in a vehicle, etc.

The AR Trigger Cover will offer substantially increased safety and security for anyone who uses the device whether on duty or recreationally.

Hand Stop/Safety Strap

See sketch—to enhance safety and preclude loss of grip—Barrels on the AR platform and variants, and other semi auto and select fire and full auto firearms and weapons are getting shorter and shorter with the increased demand of Personal Defense Weapons (PDW) and submachine guns and semi auto variants. There are also full power carbine cartridges (e.g. 300 BLK) that are designed to work with extremely short (<10.3" down to about 5-6.5") Barrels. While this creates an extremely compact firearm, it creates certain safety challenges. In short, it is very easy to burn your hand on a hot barrel or suppressor—or expose skin to extremely hot, high pressure exhaust gas. None of these are desirable, and all are dangerous.

To increase safety for the shooter, and enhance the stability of the shooters grip, this author proposes the use of a safety strap which is mounted to at lease one point on the receiver or handguard/rail and prevents the shooters support hand (that which is not on the firing grip) from travelling past the safe area of the firearm out to the barrel or the suppressor or the muzzle- or worst, past any of these points. The former may result in a burn—the latter may result in a gunshot wound or loss of limb.

Though described as a "strap", the device may be made of any suitable material such as but not limited to fabric, leather, webbing, polymer, etc. It may preferably be adjustable with any method such as buckles or Velcro, etc, The goal being that it not only constrains forward movement of the support hand but ideally also precludes the support hand from coming off of the rail or handguard—that is losing contact with the rail/handguard when shooting or moving, etc. That is, the Stop/Strap effectively stops the loss of grip not only in a forward manner but also in a radial (outward) direction. Because the barrels are so short this is crucial because if a short barrel firing a powerful round (esp carbine class) "sweeps" the shooters arm or leg due to a loss of grip and a negligent discharge occurs—this situation will result in severe injury with a significant likelihood of death. Carbines with longer barrels (e.g. 14.5-16" plus) make it more difficult to create this situation—whereas very short barrel guns are similar to handguns wherein "sweeping" oneself is altogether too easy.

The rail or handguard is static—that it, it does not move. While very short barrel pump action shotguns had used this due to hand movement (i.e. racking the action)—this would be for non moving portions of a firearm firing rifle or pistol caliber rounds. Also, the shotgun systems used a dedicated hand grip which was slotted for a safety strap—that typically only fired 3-5 rounds before reloading and was not fired suppressed. Thus the heat exposure was effectively a non issue. This author is unaware of any such thing for PDW or carbine style firearms or weapons—thus the need for this invention.

The Anchor Point(s) (either A or B may be used alone, though preferably either may connect to C) may be adjacent to the Rail or Handguard such as shown on B and C. Optionally they may extend away from the Rail/Handguard as shown in A. Either or both ends may be adjacent to or away from the Rail/Handguard as desired by the user and permitted under regulation. The critical attribute is that the forward movement of the hand past the Rail or Handguard to the barrel or muzzle or suppressor or muzzle device, etc. is prevented.

Scope Mount—Electro Optic

The use of a scope mount with adjustable height capability—primarily targeted at Electro Optic (EO) attachments which fit forward (in some cases rearward) of a "Primary" optic is disclosed. Electro Optics typically include image intensifiers (i.e. thermal or night vision, etc.) to help discern targets in challenging light conditions (i.e. non daylight). The issue is that the EO attachments may sit at a different height above the bore/action than the primary optic. This invention is designed to adjust to overcome any discrepancy between the lenses of the primary optic and the EO.

This may be accomplished by any suitable method—including spacers, a "screw" method where turning a device/handle/nut/etc changes the effective height, or it may use a cam or ratchet system to accomplish the necessary adjustments and overcome the difference in lens placement to maximize device and shooter effectiveness.

Charging Handle—See FIG. 10

As described before and repeated here, the Charging Handle may be improved a number of ways. The Top contact area may be widened or lengthened- or more than 1 top contact point may be used. There may be a gap between the contact or bearing area whether on the top or the sides of the Charging Handle. The Contact areas on the side of the outer surface of the Charging Handle may have a gap between them and the contact areas may be raised above the main outer surface on the sides. The outer surface may be recessed to allow for fouling or debris to gather without impeding operation of the gun. Tabs marked 142 may be moved forward to the front of the charging handle, and the channel 144 may be lengthened—that is, continued through handle 147. The rear of Handle 147 may be extended rearwardly to permit additional lengthening of channel 144. The small pin shown on handle 147 may be moved away from channel 144. Essentially the Channel 144 can be made longer than the extant 5.55"-5.85" or so length of the current channel to permit the use of ultra long travel Bolt Carrier systems which currently impact the Charging Handle with as little as about 0.415-0.425" or so of additional rearward movement or travel. Thus increasing this distance by as much as about 0.150" to preferably about, 250" is desired with an increase in the slot/channel length of about 0.225-0.500" is more desirable and an increase in the channel length of about 0.450-0.720" is more desirable. If the Handle 147 is lengthened, then increases in channel length beyond about 0.720" to about 1.00" or even 1.25" or more are possible. These figures are for a AR15 pattern firearm, allowances should be made for larger or different caliber or receiver sizes. The pin or pins and other materials related to the latch need to be moved in such a way that the channel length can be elongated as desired and necessary—thus that these components do not present an impediment to longer channel length.

Safety/Selector—See Sketch "Safety Using >1 Position or Length"

The use of a safety or selector with levers that are adjustable is repeated here—that is the length of the lever accessible to the shooter as measured from the center of the safety "barrel" (the part located within the receiver transiting between the boles in the receiver for same—marked X in the sketch) outer diameter (OD) is stated. That is—the distance from the center of the barrel OD—the lever may be moved "up" to make it shorter or "down" to make it longer—as shown in the sample Adjustment Range. Shooters with larger hands often prefer shorter levers while shooters with smaller hands often require longer levers. This has an added benefit with proper design of having surfaces on both sides of the safety barrel center which can be used to manipulate the weapon between "safe" and "fire" or in the case of select fire versions also between "Fire" (semi auto) and "Full" (full auto). In long days at the range, it is often useful to be able to "push" the selector back from Fire to Safe with the pad or fingertip of your thumb—rather than "lifting" the lever with the side of your thumb. Having an adjustable length with control surfaces on more than one side of the "barrel" accomplishes this.

The center of the Barrel is marked "x" in the sketch, and the adjustment portion of the lever—which permits tactile movement by the shooter—is on both sides of the center point. The red arrows in the sketch show how the Lever or Arm may be raised or lowered as the Shooter prefers it adjusted—and that the Adjustment Portions of the lever may be on either side of the Center (marked X). This permits "push" or "Pull" techniques to be used to maximize efficiency by the shooter.

Use of Different Hardness Materials BBL/GB to Seal

The use of components with significantly different levels of hardness is disclosed. This is do help seal any gaps between the Barrel and the Gas Block. The barrel will often be softer than the gas block. Ideally the gap in hardness levels will be 20-45 HRC (Rockwell C) or more. This has been found surprisingly effective at sealing off any gas leakage between the components—to the point that after post firing examination effectively any meaningful gas leakage was eliminated. This author has not seen such an effective technique—even where the gap between the barrel and gas block was less than 0.001". Either component may have a softer (less hard) finish or material—the important point is that they be different to ensure the most reliable sealing possible.

In the post firing examination cited above, several hundred rounds were fired at a very abusive schedule to include full auto fire. Literally no evidence of gas leakage was seen between the components—so the leakage was stopped, and importantly the material showed no sign of degradation even with extremely intense heat and gas pressure. Normally, even when tolerances are extremely tight (ideally <0.001" combined gap, preferably no more than 0.0015" or maximum 0.002" combined gap) there is significant evidence of gas leakage which impacts cycling consistency until the gaps are filled with carbon—sealing the system.

The use of softer materials such as coatings may be used as a "sealer" that crushes when forced against a harder material and thus creates the most leak proof seal possible. An example of the use of a ceramic based coating as a de facto "gap filler"—where it is soft enough that even tightly fitted components (<0.0015" total gap) fit together and tough enough that no sign of wear or blast to the material was shown. Though ceramic based coating is cited, any and all suitable materials and coatings should be considered for use. Essentially, this has made the seal the best possible fit.

The key is that the mating components must use different materials that have different surface hardness so that the harder one is the "crusher" and the other (softer) is the "sealer". This dramatically extends the sealing effectiveness as noted but also creates a much larger window of possible size ranges. While the machined sizes can be held very tight (e.g. <0.0005"), the cost and complexity of holding this becomes very high and production at any kind of larger scale becomes virtually impossible. This is because most tolerances—even in high precision manufacturing are +/−0.0002". Further, assembly of such tightly mated parts can be extremely difficult. The softer/harder material approach yields extremely positive results.

All the changes described herein are made to increase the safety and efficiency of the firearm or weapon. All travel or stroke changes made are disclosed with the idea of maximizing the overtravel of the Bolt Lugs past the Bolt catch greater than about 0.200" or so and preferably to the greatest extent possible.

What is claimed is:

1. A firearm comprising:

a lower receiver with a top edge;

a bolt carrier assembly comprising:

a bolt carrier configured to slideably engage with a bolt along a first axis, wherein the bolt is configured to engage and disengage from lugs of a barrel extension of the firearm; and a firing pin configured to slideably engage with the bolt carrier assembly along the first axis, wherein the firearm further comprises:

a trigger assembly comprising:

a trigger pivotally connected to the firearm;

a disconnector configured to engage with the trigger; and a hammer configured to engage with the trigger and having a firing pin contact portion configured to rotate upward to a vertical most position and contact a firing pin, wherein the hammer further comprises an extended surface that is configured to contact a portion of the bolt carrier when the bolt carrier travels in a rearward direction after firing of the firearm, wherein the extended surface extends from about 0.952 inches to about 1.80 inches above the top edge of the lower receiver when the hammer is rotated upward to the vertical most position.

2. The firearm of claim 1, wherein the extended surface extends less than 1.50 inches above the top edge of the lower receiver when the hammer is rotated upward to the vertical most position.

3. The firearm of claim 2, wherein the hammer has a width between about 0.300 inches and about 0.315 inches.

4. The firearm of claim 1, wherein the hammer has a width between about 0.150 inches and 0.299 inches.

5. The firearm of claim 1, wherein the bolt carrier is configured to travel a distance greater than approximately 3.75 inches.

6. The firearm of claim 5, wherein the bolt carrier is configured to travel a distance between 4.175 inches and 4.35 inches.

7. A hammer usable with a firearm having a bolt carrier that is configured to travel forward and rearward within the firearm during a firing operation of the firearm, the hammer comprising:

a mounting portion configured to rotatably constrain the hammer within the firearm;

a firing pin contact portion configured to rotate upward to a vertical most position and contact a firing pin;

a sear notch configured to contact a trigger; and an extended surface that is configured to contact a bottom portion of the bolt carrier when the bolt carrier travels in a rearward direction after firing of the firearm, wherein the extended surface extends from about 0.952 inches to about 1.80 inches above a top edge of a lower receiver of the firearm when the hammer is rotated upward to the vertical most position.

8. The hammer of claim 7, wherein the extended surface is configured to extend less than 1.50 inches above the top edge of the lower receiver when the hammer is rotated upward to the vertical most position.

9. The hammer of claim 8, wherein the hammer has a width between about 0.300 inches and about 0.315 inches.

10. The hammer of claim 7, wherein the hammer has a width between about 0.150 inches and 0.299 inches.

11. The hammer of claim 10, wherein the extended surface is configured to extend less than 1.5 inches above the top edge of the lower receiver when the hammer is rotated upward to the vertical most position.

12. The hammer of claim 7, wherein the extended surface is configured to contact the bolt carrier as the bolt carrier travels a distance greater than approximately 3.75 inches.

13. The hammer of claim 12, wherein the extended surface is configured to contact the bolt carrier as the bolt carrier travels a distance between 4.175 inches and 4.35 inches.

14. A trigger assembly usable with a firearm having a bolt carrier that is configured to travel forward and rearward within the firearm during a firing operation of the firearm, the trigger assembly comprising:

a trigger pivotally connected to the firearm;

a disconnector configured to engage with the trigger; and a hammer configured to engage with the trigger and having a firing pin contact portion configured to rotate upward to a vertical most position and contact a firing pin, wherein the hammer further comprises an extended surface that is configured to contact a portion of the bolt carrier when the bolt carrier travels in a rearward direction after firing of the firearm, wherein the extended surface extends from about 0.952 inches to about 1.80 inches above a top edge of a lower receiver of the firearm when the hammer is rotated upward to the vertical most position.

15. The trigger assembly of claim 14, wherein the extended surface is configured to extend less than 1.50 inches above the top edge of the lower receiver when the hammer is rotated upward to the vertical most position.

16. The trigger assembly of claim 15, wherein the hammer has a width between about 0.300 inches and about 0.315 inches.

17. The trigger assembly of claim 14, wherein the hammer has a width between about 0.150 inches and 0.299 inches.

18. The trigger assembly of claim 14, wherein the extended surface is configured to contact the bolt carrier as the bolt carrier travels a distance greater than approximately 3.75 inches.

19. The trigger assembly of claim 18, wherein the extended surface is configured to contact the bolt carrier as the bolt carrier travels a distance between 4.175 inches and 4.35 inches.

* * * * *